US007610737B2

(12) United States Patent
Kovacs

(10) Patent No.: US 7,610,737 B2
(45) Date of Patent: Nov. 3, 2009

(54) CONTINUOUS MOTION WRAPPING METHOD

(75) Inventor: Lloyd Kovacs, Sheboygan, WI (US)

(73) Assignee: Valley Tissue Packaging, Inc., Kaukauna, WI (US)

( * ) Notice: Subject to any disclaimer, the term of this patent is extended or adjusted under 35 U.S.C. 154(b) by 0 days.

(21) Appl. No.: 11/507,904

(22) Filed: Aug. 22, 2006

(65) Prior Publication Data

US 2008/0072545 A1 Mar. 27, 2008

(51) Int. Cl.
*B65B 9/10* (2006.01)
*B65B 51/30* (2006.01)

(52) U.S. Cl. ..... 53/450; 53/547; 53/550; 53/374.6; 83/16; 83/171

(58) Field of Classification Search ..... 53/450, 53/461, 547, 550, 374.6; 83/16, 171, 353
See application file for complete search history.

(56) References Cited

U.S. PATENT DOCUMENTS 2,296,142 A * 9/1942 Campbell ..... 53/51
2,931,148 A * 4/1960 Smith ..... 53/450
3,229,442 A * 1/1966 Gram ..... 53/450
3,438,173 A * 4/1969 Omori ..... 53/479
3,664,088 A 5/1972 Sherman
3,800,498 A * 4/1974 Suzuki ..... 53/77
3,925,139 A 12/1975 Simmons
3,973,372 A * 8/1976 Omori ..... 53/441
4,017,713 A 4/1977 Lodi
4,048,885 A * 9/1977 Miyakita et al. ..... 83/353
4,317,322 A * 3/1982 Lancaster et al. ..... 53/399
4,429,513 A * 2/1984 Beckers et al. ..... 53/547
4,525,977 A * 7/1985 Matt ..... 53/55
4,590,735 A 5/1986 Dohrendorf
4,738,079 A * 4/1988 Lancaster et al. ..... 53/450
4,796,499 A 1/1989 Achelpohl
4,860,621 A 8/1989 Totani
4,870,802 A * 10/1989 Cerf ..... 53/442
5,079,902 A * 1/1992 Seko et al. ..... 53/450
5,140,800 A * 8/1992 Martin et al. ..... 53/441
5,195,300 A * 3/1993 Kovacs et al. ..... 53/438
5,205,808 A 4/1993 Gebhardt
5,244,449 A 9/1993 Totani
5,271,210 A * 12/1993 Tolson ..... 53/550
5,285,621 A * 2/1994 Ballestrazzi et al. ..... 53/556
5,329,745 A * 7/1994 Suga ..... 53/75
5,337,542 A * 8/1994 Omori ..... 53/550
5,347,791 A * 9/1994 Ginzl et al. ..... 53/450
5,351,464 A * 10/1994 Francioni ..... 53/450
5,374,232 A 12/1994 Cipollone
5,410,800 A 5/1995 Gray
5,475,964 A * 12/1995 Fiesser et al. ..... 53/75
5,524,420 A * 6/1996 Ikuta ..... 53/450
5,564,261 A * 10/1996 Kiner ..... 53/439
5,653,085 A * 8/1997 Suga ..... 53/75
5,689,942 A * 11/1997 Suga ..... 53/550
6,003,288 A 12/1999 Sperry et al.
6,050,065 A * 4/2000 Bonde ..... 53/550

(Continued)

*Primary Examiner*—Stephen F Gerrity
(74) *Attorney, Agent, or Firm*—Boyle Fredrickson, S.C.

(57) ABSTRACT

A method, system, and apparatus for separating products, such as napkins or rolls of paper, encased in a tube of continuously moving thermoplastic wrapping material into product units is disclosed. At predetermined intervals spaced products are fed into the tube at wrapper length intervals, and the tube is thermally cut at wrapper intervals to form individually girth wrapped articles.

12 Claims, 9 Drawing Sheets

U.S. PATENT DOCUMENTS 6,254,521 B1 7/2001 Pansier et al.
6,557,322 B2 * 5/2003 Strasser ..... 53/374.4
6,629,400 B1 * 10/2003 Offermann et al. ..... 53/374.6
6,662,527 B1 * 12/2003 Suga ..... 53/374.6
6,854,242 B2 * 2/2005 Stork et al. ..... 53/53
6,898,922 B2 5/2005 Reist
2003/0159401 A1 * 8/2003 Sorenson et al. ..... 53/374.6

* cited by examiner

CONTINUOUS MOTION WRAPPING METHOD

BACKGROUND OF THE INVENTION

1. Field of the Invention

The present invention relates to a method and apparatus for wrapping products such as napkins, rolls of toilet paper and paper towels. More particularly, the present invention relates to a method and apparatus for the continuous wrapping of products, wherein a continuously fed wrapping material is formed into a tube, articles are fed into the tube, and the tube is separated between the sequential units of products at spaced intervals by a heated cutting element moving along the path of the tube.

2. Discussion of the Related Art

A wide variety of consumer products are mass production wrapped in a heat sealable wrapping material before being delivered to the customer. For example, numerous paper products such as napkins, paper toweling rolls, or toilet paper rolls are wrapped in a thermoplastic material such as polyethylene. The thermoplastic wrapper serves to hold the articles tightly together and to protect them from moisture and abrasion.

As is often the case for products prepared for the consumer mass market, the cost per unit article is strongly dependent on the amount of time required for each operation, including packaging. Known prior art wrapping machines require the product to be displaced from its direction of motion several times during the packaging operation to produce a sealed overwrap of heat sealable material around the product and then to fold and heat seal the ends of the packaging about the product. The displacements and reciprocations of the product within the machine limit the production speed because of the time that must be allocated to such motions. Additionally, the motions of the machine parts required to change the direction of motion of the articles invariably leads to shock and vibration which can become severe as machine speed is increased. In addition, the mechanism for separating the heat sealable material is also crucial to the performance and efficiency of the machine. In many prior art devices, the speed of the wrapping machine is often limited by reason of having to cut a tube transversely as it is continuously fed forward. The cutting step makes it difficult or impossible to achieve a fully compressed or tightly wrapped product.

The below-referenced U.S. patents disclose embodiments that were at least, in part, satisfactory for the purposes for which they were intended. The disclosures of all the below-referenced prior United States patents in their entireties are hereby expressly incorporated by reference into the present application for purposes including, but not limited to, indicating the background of the present invention and illustrating the state of the art.

U.S. Pat. Nos. 2,545,243; 2,982,334; 3,011,934; 3,050,916; 3,133,390; 3,153,607; 3,325,331; 3,576,694; 4,054,474; and 4,084,999 disclose various methods for the formation of a heat sealed wrapper about an article. The devices of many of these references, while somewhat satisfactory for their intended purpose, operate on reciprocating motion and include numerous moving parts in, e.g., their flighted infeed systems. The flighted infeed systems disclosed are often slave driven by the upstream folder machines and as a result, flight jams are commonly caused by timing issues.

U.S. Pat. No. 4,430,844 to James discloses a machine capable of forming sealed wrappers around articles. The machine disclosed in the James patent achieves separation of articles by introducing transverse lines of weaknesses into a flat film at measured intervals representing the wrapper length. The film is then formed into a tube and articles to be wrapped are introduced into the continuously moving tube. Separation into individual packages is achieved as leading wrapped package is pulled forward at a higher speed thereby severing it from a tube at the line of weakness. Although this method works for film or paper wrapping material, special care must be taken to ensure good film tension control as well as perforation geometry in order to avoid premature separation. The machine is also extremely sensitive to variations in film properties and does not allow for product compression.

U.S. Pat. No. 4,218,863 to Howard et al. also discloses a method and apparatus for forming sealed wrappers around articles. The machine disclosed in the Howard patent achieves separation of articles by cutting of the tubular film with a rotating serrated knife. The disclosed method works for film, but it is generally limited to single roll products.

In view of the above, it will be apparent to those skilled in the art from this disclosure that there exists a need for an improved system, apparatus and method for wrapping articles. It is preferred to have a wrapping machine that can receive articles to be wrapped and form an overwrap on the articles in substantially continuous motion through the machine. It is further desirable for a continuous motion wrapping assembly that allows much higher production speeds to be obtained. There is a further need for improvements to the infeed systems and cutting systems of known continuous motion wrapping assemblies. This invention addresses this need in the art as well as other needs, which will become apparent to those skilled in the art from this disclosure.

SUMMARY AND OBJECTS OF THE INVENTION

In accordance with aspects of the present invention an improved system, method and apparatus are provided for wrapping articles such as stacks of napkins, or rolls of paper, (e.g. toilet tissue or paper toweling), at relatively high speed and enabling use of various wrapping materials. In another aspect of the invention, a method and apparatus that allows for continuous wrapping of articles wherein speed is not limited by reason of having to cut or perforate the tube transversely as it is continuously fed forward is provided. In still another aspect of the invention, a method and apparatus which effects separation by thermal cutting with a heated element that moves with the moving product is provided and separates a tube without sealing the tube. In another aspect of the invention, an infeed system for a wrapping assembly that eliminates the use of flight bars and the problems associated with flighted infeed systems is provided. In a further further aspect of the invention, an alternative to infeed systems that are slave driven by upstream folder machines is provided. In another aspect of the invention, an infeed system that allows for the compression of the products as they move through the infeed system such that the product is unaffected by its movement at a high speed is provided.

Consistent with the foregoing, and in accordance with the invention as embodied and broadly described herein, method of wrapping products in a tubular thermoplastic material, a continuous wrapping system and a cutting assembly for a continuous wrapping system are disclosed in suitable detail to enable one of ordinary skill in the art to make and use the invention. In accordance with a first aspect of the invention, the above and other objects are achieved by providing a method of wrapping products in a tubular thermoplastic material. The method includes the steps of forming a continuously moving tube of thermoplastic material from a web of material, delivering spaced product units to be wrapped into the tube and separating the spaced product units in the tube from one another with a heated cutting element.

In one example, the heated cutting element is moveable in two mutually orthoganol directions directions and the step of separating the spaced product units from the tube includes moving the heated cutting element transversely through the tube and horizontally in the same direction as the continuously moving tube of thermoplastic material. The movement of the heated cutting element may match the velocity of the movement of the tube. The step of separating the spaced product units from the tube may include making a first cut in the tube in a downward transverse motion and making a second cut in the tube in an upward transverse motion.

In yet another example, the heated cutting element is mounted on at least one moveable carriage moveable in a first orthoganol direction and the moveable carriage is mounted on at least one carriage arm moveable in an alternative orthoganol direction. The carriage arm may be mounted on a support located adjacent a forming shoulder pull belt and may include a cantilevered heated cutting element. In one example, the spaced product units are at least one stack of napkins. Alternatively, the spaced product units are at least one roll of paper product.

In still another embodiment, a continuous wrapping system includes an infeed system in communication with a supply of product that separates one or more products into units to be wrapped. A tube wrapper forming section is included in the system and configured to form a continuously moving tube of thermoplastic material from a web of material around the units to be wrapped. A cutting assembly is configured to separate the units from one another in the continuously moving tube without sealing the tube. The heated element may be moveable in two mutually orthoganol directions. In one embodiment the speed of the moveable heated element is adjustable in both the transverse and horizontal directions. In one example, the moveable heated element makes a single cut in a cutting cycle. Alternatively, the moveable heated element makes two cuts in a cutting cycle.

In a final embodiment, a cutting assembly for a continuous wrapping system includes a heated cutting element configured to separate units in a tube of plastic material from one another without sealing the tube. The heated cutting element may be moveable in two mutually orthoganol directions. It may be moveable in the same direction and at the same velocity of the tube.

These, and other, aspects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
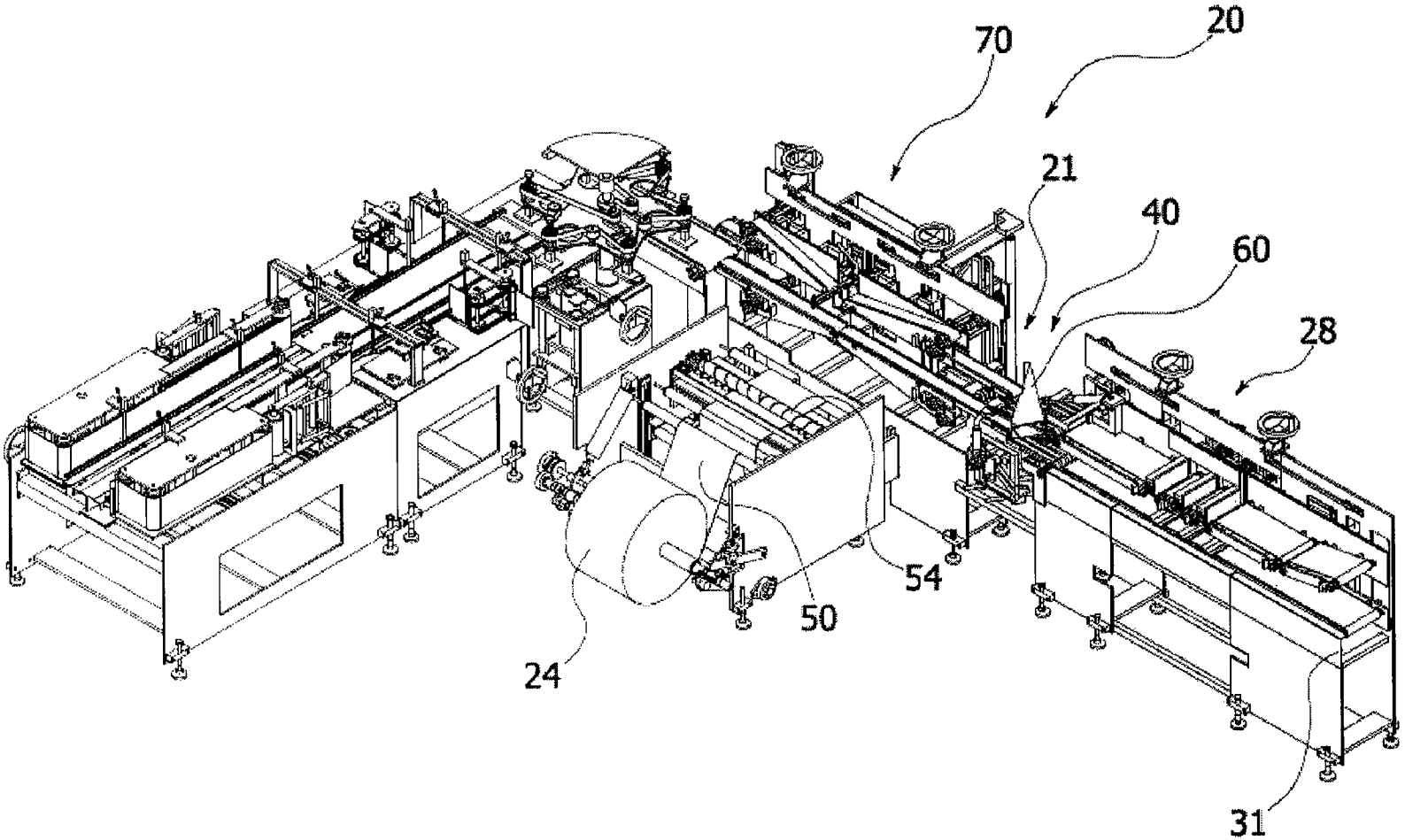
FIG. 1 is a perspective view of a continuous motion wrapping system or machine constructed in accordance with a preferrred embodiment of the present invention.

In describing the preferred embodiments of the invention that are illustrated in the drawings, specific terminology will be resorted to for the sake of clarity. However, it is not intended that the invention be limited to the specific terms so selected and it is to be understood that each specific term includes all technical equivalents that operate in a similar manner to accomplish a similar purpose. For example, the word "connected," "attached," or terms similar thereto are often used. They are not limited to direct connection but include connection through other elements where such connection is recognized as being equivalent by those skilled in the art.

DESCRIPTION OF PREFERRED EMBODIMENTS

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the below examples should not be construed as limiting the scope of the present invention.

Referring to the drawings, wherein like numerals refer to like parts in each view, an overall perspective view of a continuous motion wrapping assembly or system 20, including a wrapping apparatus or wrapping machine 21 is shown in FIG. 1. The operation of the wrapping system 20 will be described with regard to the packaging of articles or products 22, such as napkins, in wraps of polyethylene or other thermoplastic material. However, it is understood that a wide variety of other products having different shapes and sizes may be wrapped with other types of heat sealable or thermoplastic packaging material. Such alternative products 22 include, but are in no way limited to roll products such as paper towels or toilet paper.

As noted above, the illustrated embodiment is directed at wrapping product 22 into compressed packaged units 25. It is contemplated that the invention may be used to wrap units 25 of product 22 comprising, e.g., single stacks or rolls, as well as units 25 of product 22 comprising, e.g., multiple stacks or rolls. As discussed in greater detail below, the units 25 are compressed and encased in a web of continuously moving thermoplastic wrapping material (e.g. polyethylene film) fed forward from a supply roll 24 and formed into a tube 91 around the units 25. At predetermined intervals, the units 25 are fed into the tube 91 one after another and spaced lengthwise in the tube 91 at wrapper length intervals. The tube 91 of wrapping material is then cut at a position between units 25 corresponding to wrapper intervals by a moveable heated cutting element 26 such as a heated knife or wire to form individually girth wrapped units.

Figure 2:
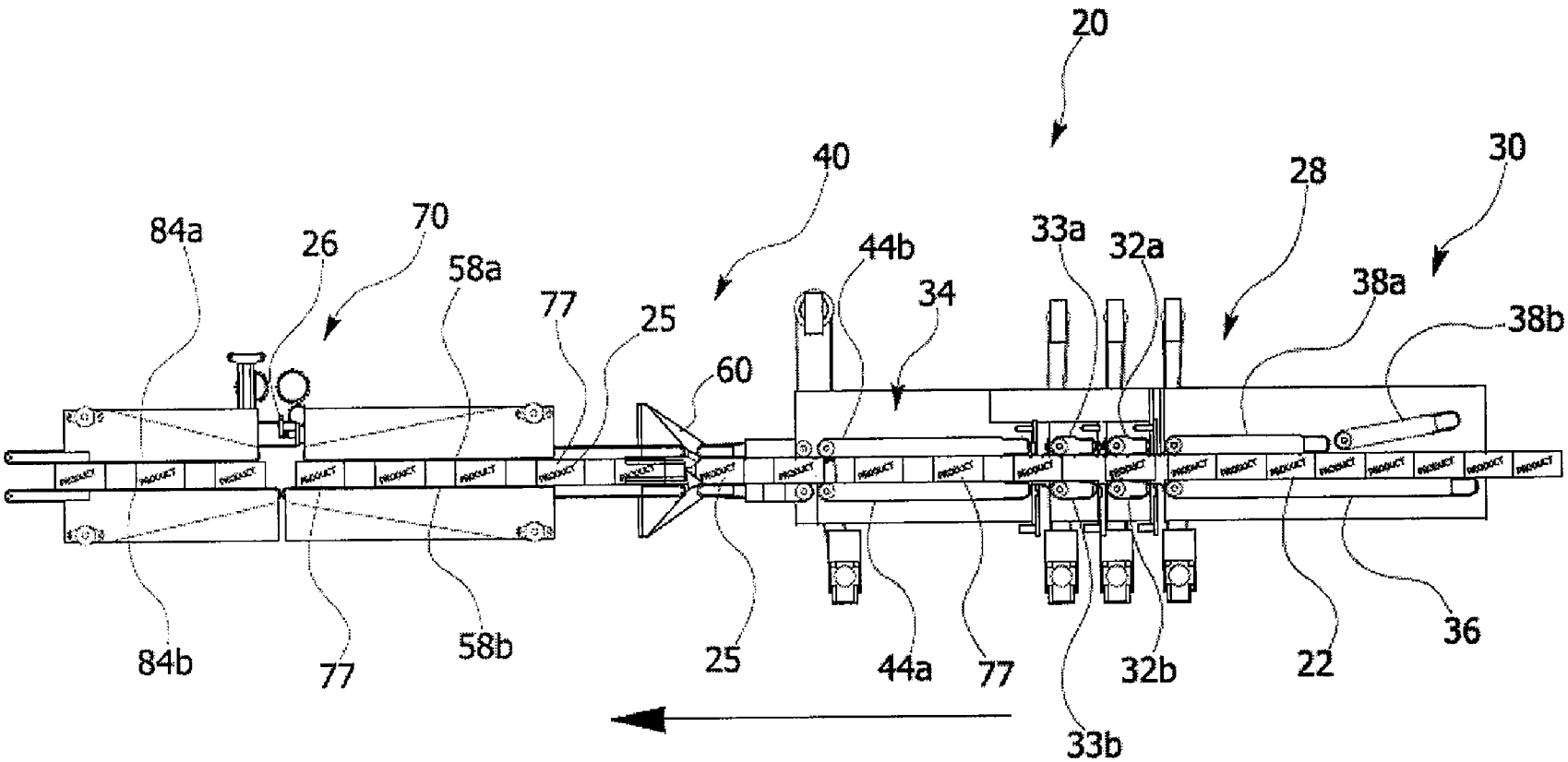
FIG. 2 is a side view of the infeed assembly and cutting assembly of the system of FIG. 1 shown separating a backlog of a continuous line of products into equally spaced wrapped single product units.
Figure 3:
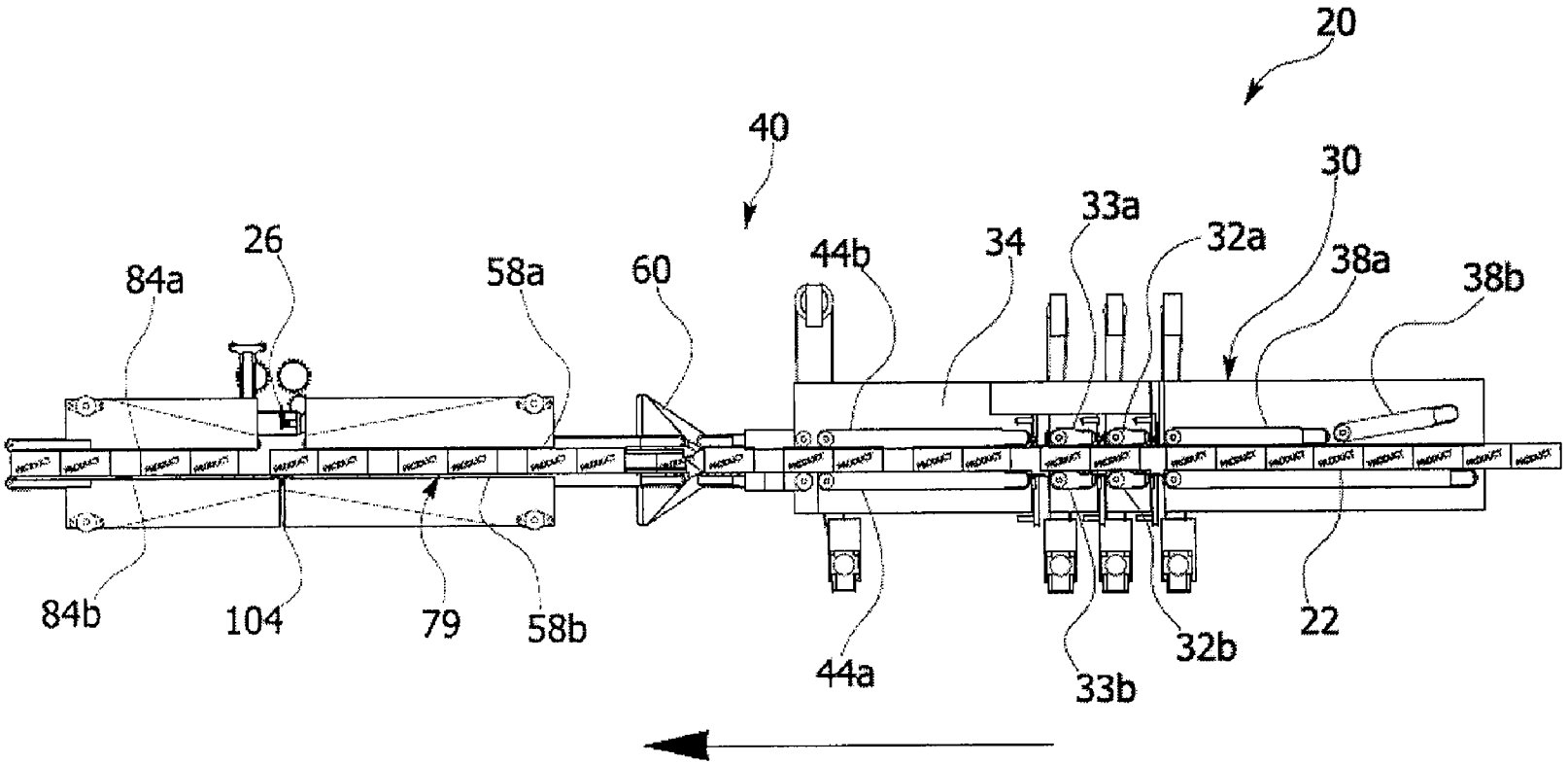
FIG. 3 is a side view of the infeed assembly and cutting assembly of the system of FIG. 1 shown separating a backlog of a continuous line of product into equally spaced wrapped two product units.

Referring to FIGS. 1-3, unwrapped product 22 (e.g., napkin stacks or paper rolls) are delivered to the continuous motion wrapping system 20 on a standard conveyor belt assembly (not shown) or by hand. In one preferred embodiment, the wrapping system 20 could include a zero back pressure conveyor to accumulate and arrange the product 22 into stacks, such as napkin stacks, in a continuous line.

The sequential product 22 received from the conveyor is then delivered to the infeed system or assembly 28. As illustrated in FIGS. 1-3, the infeed assembly 28 of the wrapping system 20 arranges the product 22 to be wrapped in longitudinal alignment and selectively spaces the product 22 into units 25. The spacing of the units 25 preferably corresponds to the preferred wrapper length size. The preferred infeed assembly 28 includes adjustable servomotor driven infeed compression belts 30, single pack registration belts 32, twin pack registration belts 33 and forming shoulder infeed belts 34. It is understood that a wide variety of alternative programmable prime movers could be used to drive the belts of the infeed assembly in addition to the disclosed servomotors. Such alternative prime movers include, but are not limited to, stepper motors and vector motors.

Preferably, the infeed compression belts 30 include a lower belt 36 and first 38*a* and second 38*b* upper belts driven by an electric servomotor connected to the frame 31. It is also contemplated that a single upper belt could be utilized. As illustrated in FIGS. 1 and 2, the lower 36 and upper 38*a*, 38*b* belts receive the continuously fed product 22 from a conveyor or other means. The product 22 is compressed between lower 36 and upper 38*a*, 38*b* belts to a preferred girth for packaging. It is understood that the space between lower 36 and upper 38*a*, 38*b* belts may be manually or automatically adjusted to account for alternative packaging needs.

Once the product 22 has moved through the infeed compression belts 30, it is continuously moved through individually servomotor (or other prime mover) driven single registration belts 32*a*, 32*b* and twin pack registration belts 33*a*, 33*b* of the infeed system 28. The single registration belts 32*a*, 32*b* and the twin pack registration belts 33*a*, 33*b* space and register the product 22 into preferred units 25. (It is understood that while the described infeed assembly 28 is preferred, prior art spacing means such as spacing bars attached to the belts, could also be used with the inventive cutting system described below.) The single registration belts 32*a*, 32*b* and the twin pack registration belts 33*a*, 33*b* are preferably programmed or alternatively controlled to move product 22 at multiple varying velocities in their continuous horizontal movement thereby spacing and registering the product into units 25 for wrapping. In addition, the single registration belts 32*a*, 32*b* and the twin pack registration belts 33*a*, 33*b* may be also compression belts, thereby serving to maintain the product 25 in a preferred girth for packaging and prevent loose product 22, such as napkins, from separating from a stack. It should be understood that the velocities of the single registration belts 32*a*, 32*b* and the twin pack registration belts 33*a*, 33*b* are selectively adjustable in relation to the velocity of the infeed compression belts 30 and forming shoulder infeed belts 34 to provide for alternative preferred spacing among single stack product units 77 (FIG. 2) or multiple, such as double stack product units 79 (FIG. 3). As described below, when only single stack product units 77 are preferred the twin pack registration belts 33*a*, 33*b* move at constant velocity in sync with the movement of the downstream forming shoulder infeed belts 34.

Figure 8A:
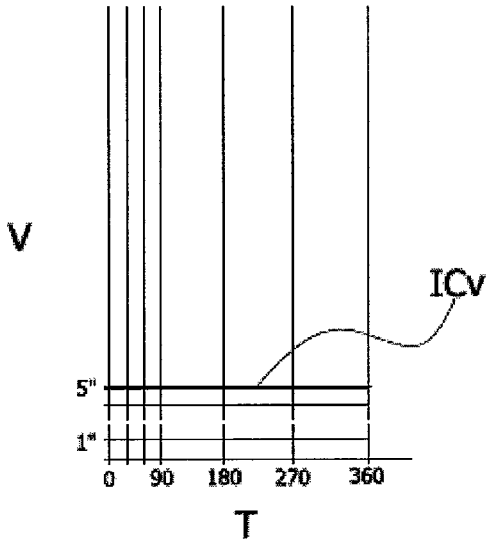
FIGS. 8A-8D are velocity profiles for the components of the infeed assembly of the system of FIG. 1 during the spacing and registration of a single stack product unit.
Figure 8B:
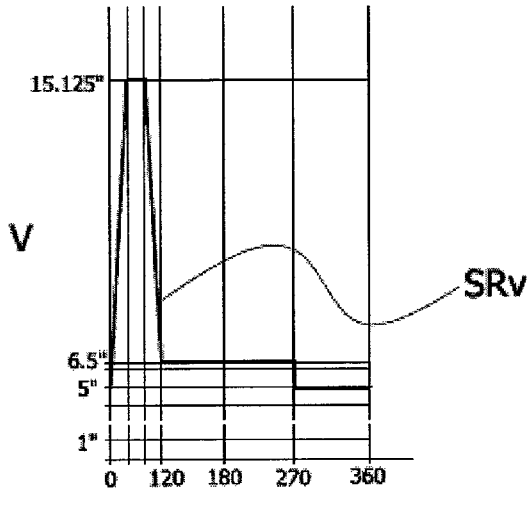
Figure 8C:
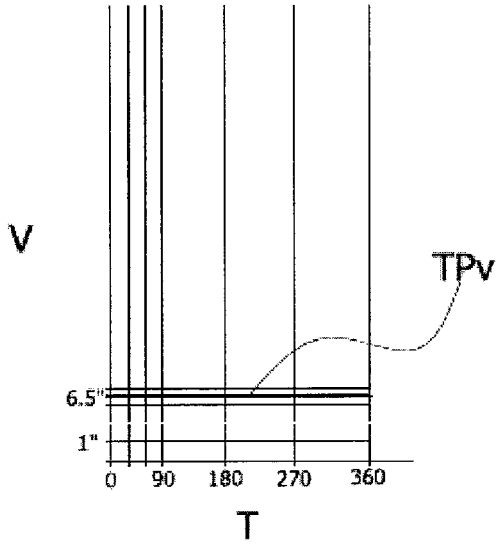
Figure 8D:
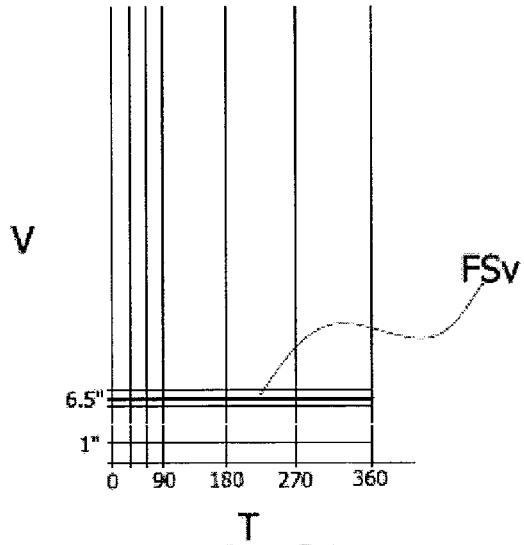

FIGS. 8A-8D are graphs illustrating the velocity profiles of the infeed compression belts 30, single registration belts 32*a*, 32*b*, twin pack registration belts 33*a*, 33*b* and forming shoulder infeed belts 34 during the spacing and registration of a single stack product unit 77. As illustrated by FIG. 8A the infeed compression belts 30 move at a constant velocity $IC_v$ throughout the wrapping process. FIGS. 8C and 8D illustrate the velocity of the twin pack registration belts $TP_v$ and the forming shoulder infeed belts $FS_v$ respectively. As illustrated, the twin pack registration belts 33*a*, 33*b* and the forming shoulder infeed belts 34 are also moving at a constant velocity throughout the wrapping process of a single stack product unit 77.

Turning to FIG. 8B the velocity of the spaced single registration belts $SR_v$ is illustrated. As shown in FIG. 8B, the single registration belts 32*a*, 32*b* initially move at a velocity equal to the velocity of the upstream infeed compression belts 30. Once a single stack product unit 77 is entirely between the single registration belts 32*a*, 32*b* and no longer in contact with the infeed compression belts 30, the velocity of the single registration belts 32*a*, 32*b* increases to a velocity greater than the velocity of the infeed compression belts 30 thereby separating the unit from the continuous line of product 22. Once separated to the preferred spacing, as the single stack product unit 77 remains between the single registration belts 32*a*, 32*b*, the velocity of the single registration belts 32*a*, 32*b* decreases to a velocity equal to the continuous velocity of the downstream twin pack registration belts 33*a*, 33*b* and forming shoulder infeed belts 34 thereby registering the product. As noted above, when a single stack/product unit 77 is desired, the velocities of the twin pack registration belts 33*a*, 33*b* and forming shoulder infeed belts 34 are preferably equal.

As the single stack product unit moves off the single registration belts 32*a*, 32*b* onto the twin pack registration belts 33*a*, 33*b*, the single registration belts 32*a*, 32*b* return to moving at a velocity equal to the infeed compression belts 30. Thus, the movement of single stack/product units 77 across the single registration belts 32*a*, 32*b* will include at least movement at a velocity equal to the upstream infeed compression belts 30, movement at a velocity greater than the infeed compression belts 30 (and forming shoulder infeed belts 34) and movement at a velocity equal to the downstream forming shoulder infeed belts 34. As noted, once the individual single stack/product unit 77 completes the movement through the single registration belts 32*a*, 32*b*, the single registration belts 32*a*, 32*b* are again moving at a velocity equal to the velocity of the infeed compression belts 30 and the single registration belts 32*a*, 32*b* are ready to receive the next product from the continuous line of product 22. It should be noted that a wide variety of alternative velocities could be set depending on the packaging needs.

Figure 9A:
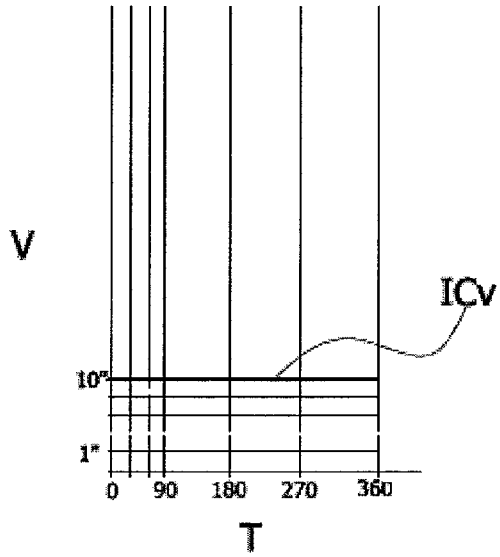
FIGS. 9A-9D are velocity profiles for the components of the infeed assembly of the system of FIG. 1 during the spacing and registration of a double stack product unit.
Figure 9B:
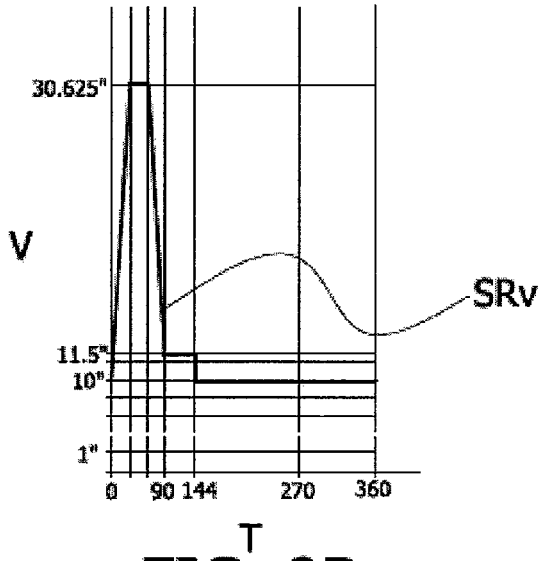
Figure 9C:
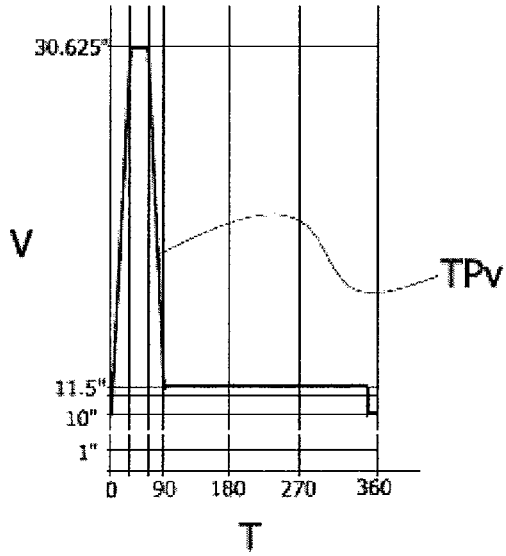
Figure 9D:
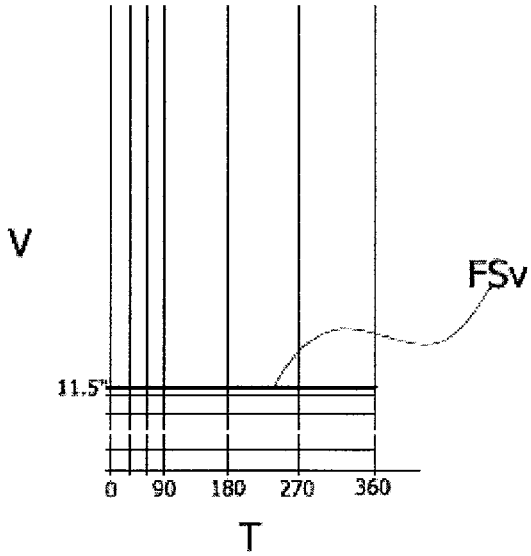

FIGS. 9A-9D are graphs illustrating the velocity profiles of the infeed compression belts 30, single registration belts 32*a*, 32*b*, twin pack registration belts 33*a*, 33*b* and the forming shoulder infeed belts 34 during the registration of multiple product units, such as double stack product units 79. As illustrated by FIG. 9A, the infeed compression belts 30 again move at a constant velocity $IC_v$ throughout the wrapping process. FIGS. 9B and 9C illustrate the velocity of the spaced single registration belts $SR_v$ and twin pack registration belts $TP_{v\ respectively}$. FIG. 9D illustrates the velocity of forming shoulder infeed belts $FS_v$ which is also moving at a constant velocity.

As shown in FIGS. 9A and 9B, when double stack product units 79 are preferred, the spaced single registration belts 32*a*, 32*b* and the twin pack registration belts 33*a*, 33*b* move at synchronized velocities during a portion of their movement. Initially, the single registration belts 32*a*, 32*b* and the twin pack registration belts 33*a*, 33*b* move at a velocity equal to the velocity of the upstream infeed compression belts 30. Once two adjacent stacks of product 22 are entirely between the single registration belts 32*a*, 32*b* and the twin pack registration belts 33*a*, 33*b* and no longer in contact with the infeed compression belts 30, the velocity of the single registration belts 32*a*, 32*b* and the twin pack registration belts 33*a*, 33*b* increases to a velocity greater than the velocity of the infeed compression belts 30 thereby separating a double stack product unit 79 from the continuous line of product 22. Once separated to the preferred spacing, as the double stack product unit 79 remains between the single registration belts 32*a*, 32*b*, and the twin pack registration belts 33*a*, 33*b*, the velocity of the single registration belts 32*a*, 32*b* and the and the twin pack registration belts 33*a*, 33*b* decreases to a velocity equal to the continuous velocity of the forming shoulder infeed belts 34 thereby registering the product. As the double stack product unit 79 moves off the single registration belts 32*a*, 32*b*, the single registration belts 32*a*, 32*b* decreases its velocity to a velocity equal to the velocity of the infeed compression belts 30. Moments later as the double stack product unit 79 moves off the twin pack registration belts 33*a*, 33*b*, the twin pack registration belts 33*a*, 33*b* decreases its velocity to a velocity equal to the velocity of the infeed compression belts 30. The single registration belts 32*a*, 32*b* and the twin pack registration belts 33*a*, 33*b* are then ready to receive the next product from the continuous line of product 22.

As described above, the servomotor or other prime mover driven infeed system 28 allows a user to backlog a continuous line of product 22 and separate the product 22 into spaced units 25. Due to the orientation of the single registration belts 32*a*, 32*b* and twin pack registration belts 33*a*, 33*b* the product 22 may be formed into single stack product units 77 or multiple, such as double stack product units 79. In addition, the product 22 remains compressed without damage to the product from backpressure push. As a result, the in-feed system 28 eliminates the problems associated with prior art flighted infeed systems. It should be understood that in addition to the single 32 and twin pack 33 registration belts, the infeed assembly could include other belts capable of forming, for example three, four or more aligned stacks of product 22.

Upon exiting the single registration belts 32*a*, 32*b* or the twin pack registration belts 33*a*, 33*b* of the infeed assembly 28, single stack product units 77 or double stack product units 79 (FIG. 3) are driven forward along forming shoulder infeed belts 44*a*, 44*b* one after another into a tube wrapper forming section 40 of the wrapping assembly 20. The units 77 or 79 are spaced at intervals corresponding to a wrapper length interval and inserted into a tube 91.

A variety of known tube forming mechanisms could be utilized and incorporated into the inventive wrapping system 20. In the preferred embodiment, a web 50 of thermoplastic material is positively continuously pulled from the supply roll 24 and fed forward in a horizontal path towards the tube wrapper forming section 40 of the wrapping assembly 20. The web is preferably driven by a prime mover such as a servomotor at the same velocity as the forming shoulder product-pull belts 58*a*, 58*b* which are downstream in the horizontal path of the forming shoulder infeed belts 44*a*, 44*b*. The web then travels forward from the rolls 52, 54 until its is redirected by a turning bar (not shown). The web then travels rearward relative to a tube feed means (not shown), and is trained under and up around a guide roll to the tube forming shoulder 60. The tube forming shoulder 60 is generally known in the art, with minor modifications for purposes of this invention. The forming shoulder is arranged such that as the web 50 travels up and around the shoulder 60, it is formed into a tube and, as it proceeds through a tubular guide, it becomes wrapped around the single stack product units 77 or double stack product units 79 as is known in the art. The single stack product units 77 or double stack product units 79 are also pulled forward and delivered into the tube 91 by forming shoulder product pull belts 58*a*, 58*b*. The product pull belts 58*a*, 58*b* are also driven by a servomotor or other prime mover at an adjustable speed corresponding to the movement of a heated cutting element 26 as discussed below.

The forming shoulder product pull belts 58*a*, 58*b* and the web feed rolls 52 feed the web 50 forward from the supply roll 24 to the forming shoulder 60 where the web 50 is formed into the tube 91 at a predetermined speed. For example, in the case of a single stack product units 77 with dimensions of 5" wide by 5" long by 2" high the speed may be 80 feet per minute (corresponding to a rate of 120 units per minute). As illustrated, the forming shoulder product pull belts 58*a*, 58*b* feed the tube with the product therein forward at a predetermined speed. A drive device, preferably a servomotor, is provided for continuously driving these forward. The single stack product units 77 or double stack product units 79 inside the tube act as a back-up for the forming shoulder product pull belts 58*a*, 58*b*. The forming shoulder product pull belts 58*a*, 58*b* are preferably vacuum belts, having vacuum holes, and vacuum boxes being provided on the inside of their forward traveling reaches, for effecting vacuum gripping of the tube by the forming shoulder product pull belts 58*a*, 58*b* via the holes. Alternatively, each of the forming shoulder product pull belts 58*a*, 58*b* may be composed of a flexible material having relatively good surface friction with respect to polyethylene and other thermoplastic materials, such as a fabric backed rubber belt or certain flexible plastic belts. The upper belt 58*a*, like the other belts in the system may be adjustable toward and away from the lower belt 58*b*. Preferably the forming shoulder 60 is removable and replaceable with forming shoulders of different sizes and shapes for accommodating different products 22.

Once the spaced single stack product units 77 or double stack product units 79 have moved through the forming shoulder, the formed tube with the single stack product units 77 or double stack product units 79 is driven along the forming shoulder product pull belts 58*a*, 58*b* to the cutting assembly 70 of the wrapping system 20. The contact between the belts 58*a*, 58*b* and the tube 91 formed around the single stack product units 77 or double stack product units 79 maintains the tube 91 relatively taut and closely drawn around the product 22 within. Friction belts (not shown) may apply longitudinal tension about the periphery of the tube 91 to pull the material tight against the product 22 within.

Figure 4:
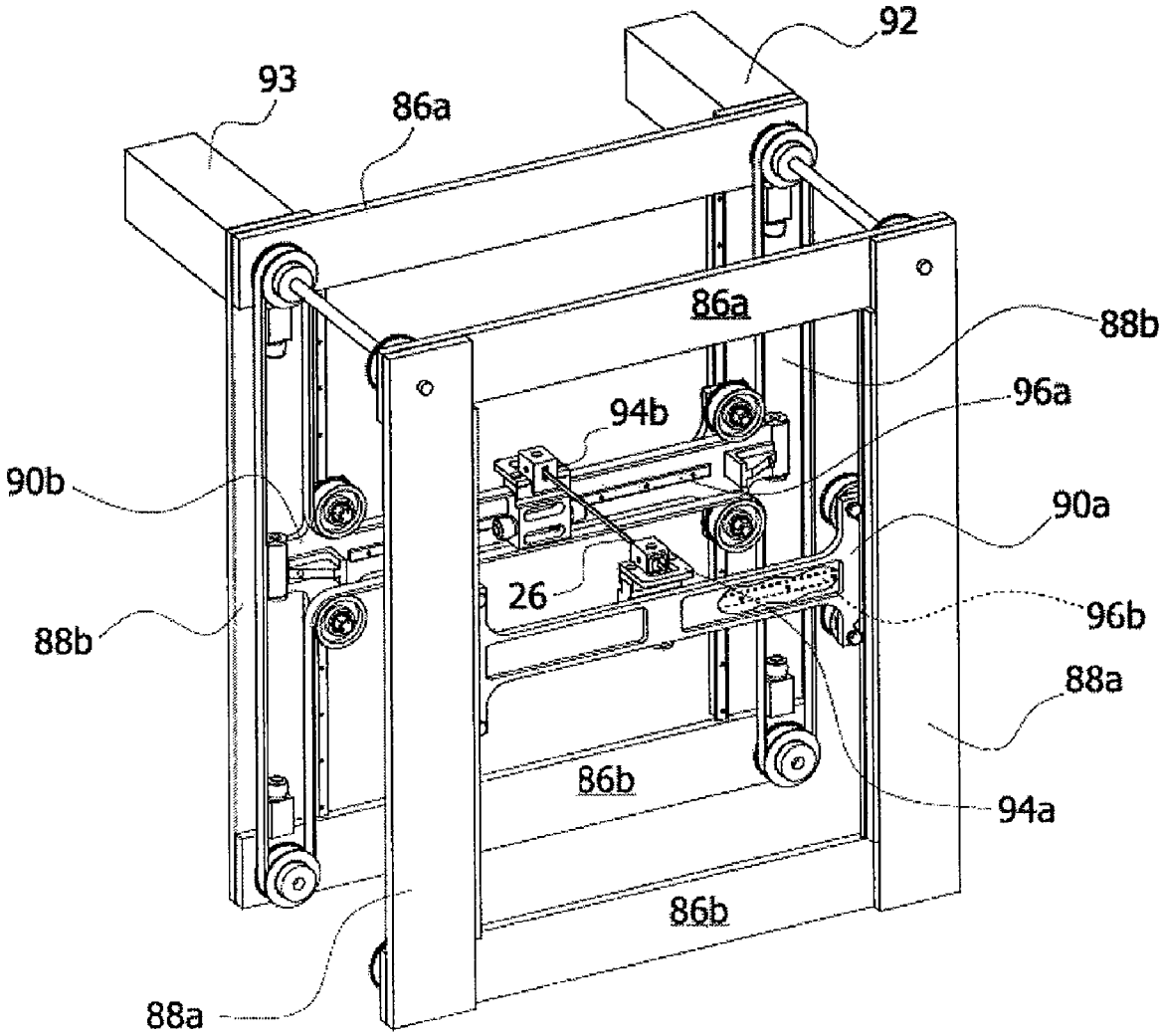
FIG. 4 is perspective view of a first embodiment of the cutting assembly of the of the system of FIG. 1.
Figure 5:
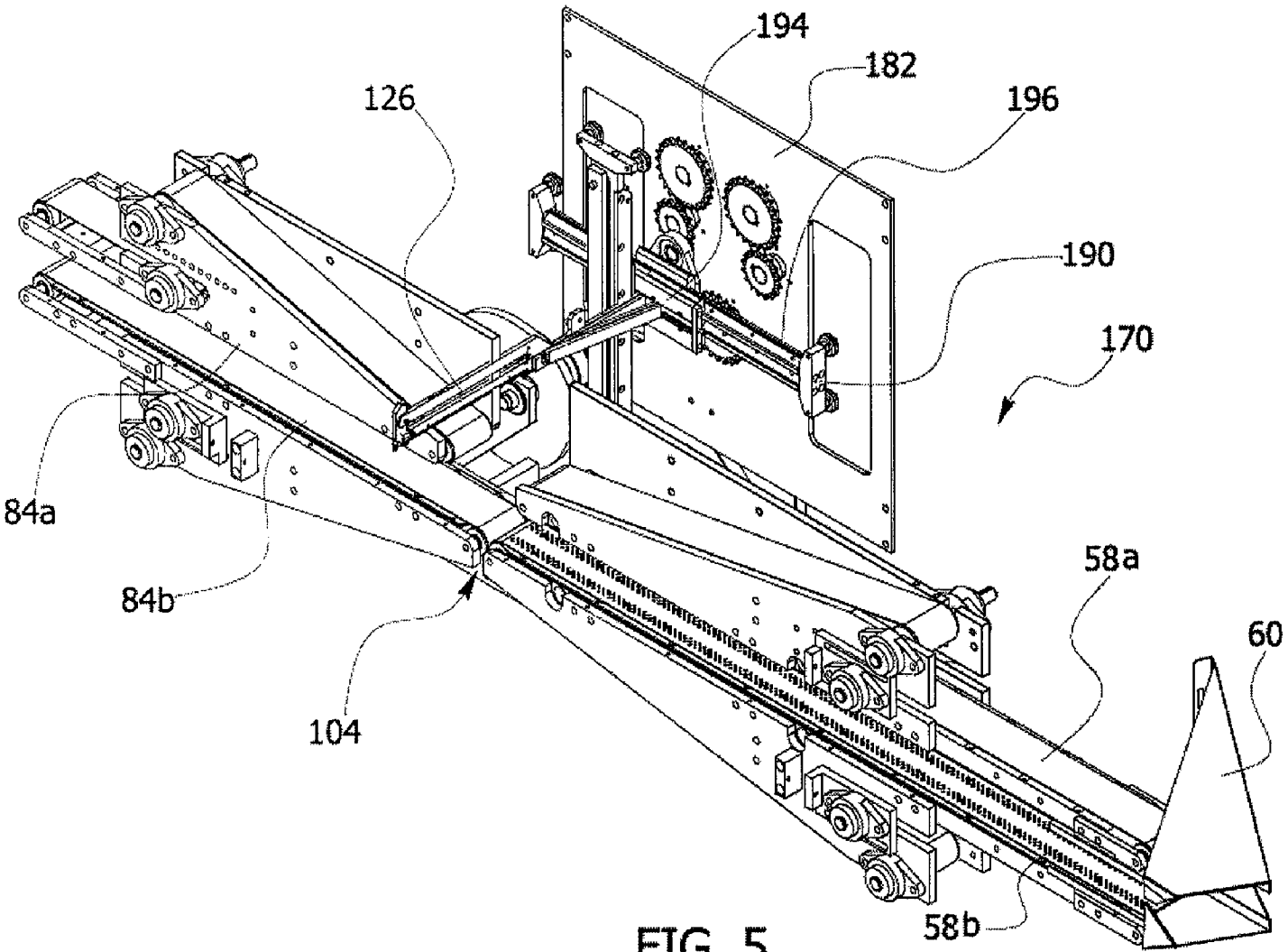
FIG. 5 is a perspective view of an alternative embodiment of the cutting assembly of the of the system of FIG. 1.

FIGS. 4 and 5 better illustrate two alternative arrangements of the cutting assembly 70 of the wrapping system 20. Both embodiments use a heated cutting element 26, such as a hot wire or knife, to cut the tube 91 of plastic surrounding the single stack product units 77 or double stack product units 79 into individually wrapped units 25. Both of the cutting assemblies illustrated in FIGS. 4 and 5 enable the heated cutting element 26 to move in a cutting cycle that includes motion in two coordinates or directions. As described in greater detail below, the cutting cycle of the heated cutting element 26 includes both horizontal (corresponding to the direction of the movement wrapping system) and transverse or vertical motion. As discussed below, at least a portion of the horizontal motion of the heated cutting element 26 matches the velocity of the continuously moving tube 91 with enclosed product 22 during a cutting function. A sufficient transverse or vertical velocity is generated to penetrate or cut a cross section of tube 91 during the cutting cycle. This transverse cutting motion is typically at a velocity greater than the horizontal motion. During the vertical motion, the heated cutting element 26 melts or separates the tube 91, resulting in film separation, without sealing of the tube, perpendicular to the direction of horizontal tube 91 movement while maintaining the tube 91 around the units 25.

Turning to FIG. 4, a first embodiment of a cutting assembly or system 70 of the packaging assembly 20 is illustrated. As illustrated in FIG. 4, a heated cutting element 26 is moveably mounted on a rectangular support 82 standing around the forming shoulder pull belts 58*a*, 58*b* and an upper 84*a* and lower 84*b* knife belt exits (FIG. 3). The heated cutting element 26 may be a heated wire, knife or other known tool that is electrically heated above the melting point of the thermoplastic material used to form the tube 91.

Support 82 includes a pair of upper 86*a* and lower 86*b* horizontal beams extending between a pair of vertical beams 88*a* and 88*b*. A pair of horizontal carriage arms 90*a*, 90*b* are respectively moveably mounted on the pairs of vertical beams 88*a*, 88*b*. The carriage arms 90*a*, 90*b* are configured to move vertically in a synchronized fashion along vertical beams 88*a*, 88*b*. The carriage arms 90*a*, 90*b* are preferably driven by belts driven by servomotors 92, 93 or other prime movers mounted to the support 82. As illustrated in FIG. 4, a pair of servomotor driven heated cutting element carriages 94*a*, 94*b* are moveably attached to tracks 96*a*, 96*b* for synchronized horizontal movement of the heated cutting element 26 on the carriage arms 90*a*, 90*b*. The heated cutting element 26 extends between the heated cutting element carriages 94*a*, 94*b*. Thus, the servos 92, 93 can be programmed to provide movement of the heated cutting element 26 in two coordinates. The synchronized horizontal carriage arms 90*a*, 90*b* move the heated cutting element 26 in a transverse or vertical direction in relation to the direction of movement of the shoulder pull belts 58*a*, 58*b* and upper 84*a* and lower 84*b* knife belt exits (FIG. 3). The synchronized heated cutting element carriages 94*a*, 94*b* provide for horizontal movement of the heated cutting element 26 in relation to shoulder pull belts 58*a*, 58*b* and an upper 84*a* and lower 84*b* knife belt exits.

FIG. 5 illustrates an alternative embodiment of a cutting system 170 of the wrapping system 20. As illustrated in FIG. 5, a cantilevered heated cutting element 126 is moveably mounted on a support 182 adjacent the forming shoulder pull belts 58*a*, 58*b* and upper 84*a* and lower 84*b* knife belt exits. A horizontal carriage arm 190 is moveably mounted to a vertical support arm 192 and support 182 for vertical movement. The horizontal carriage arm 190 is configured to move vertically along vertical support arm 192 and support 182. The horizontal carriage arm 190 is moved by belts driven by servomotors (not shown) mounted to the support 182. The heated cutting element 126 extends from a support 182 attached to a heated element carriage 194. The servo driven heated element carriage 194 is moveably attached to a track 196 on the horizontal carriage arm 190 for horizontal movement of the heated element 180 on the horizontal carriage arm 190. As a result, the servo motors can be programmed to provide movement of the heated cutting element 126 in two coordinates. Vertical movement on the horizontal carriage arm 190 moves the heated cutting element 126 in a transverse or vertical direction in relation to the direction of movement of the shoulder pull belts 58*a*, 58*b* and an upper 84*a* and lower 84*b* knife belt exits. Horizontal movement on the heated element carriage 194 provides for horizontal movement of the heated cutting element 180 in relation to shoulder pull belts 58*a*, 58*b* and an upper 84*a* and lower 84*b* knife belt exits.

It is recognized that the thermal cutting of a tubular cross section of tube 91 wrapped around the stack product units 77 or double stack product units 79 could be achieved with numerous different designs whereby the horizontal motion of enclosed articles and a heated cutting member is synchronized during a cutting cycle in order to produce a substantially perpendicular cut, without sealing the tube 91, to the direction of film travel. For example a heated cutting element 26 may be attached to a rotating mechanism or other articulated means to achieve film separation.

As discussed in greater detail below, one preferred embodiment of the invention utilizes a cutting path wherein separation of tube 91 by heated cutting element 26 takes place during one half of the cycle in a downward transverse direction and the heated cutting element 26 is then returned to its starting position along the formed cut line. In an alternative embodiment, during the return motion to starting position a second cut is made.

Figure 6A:
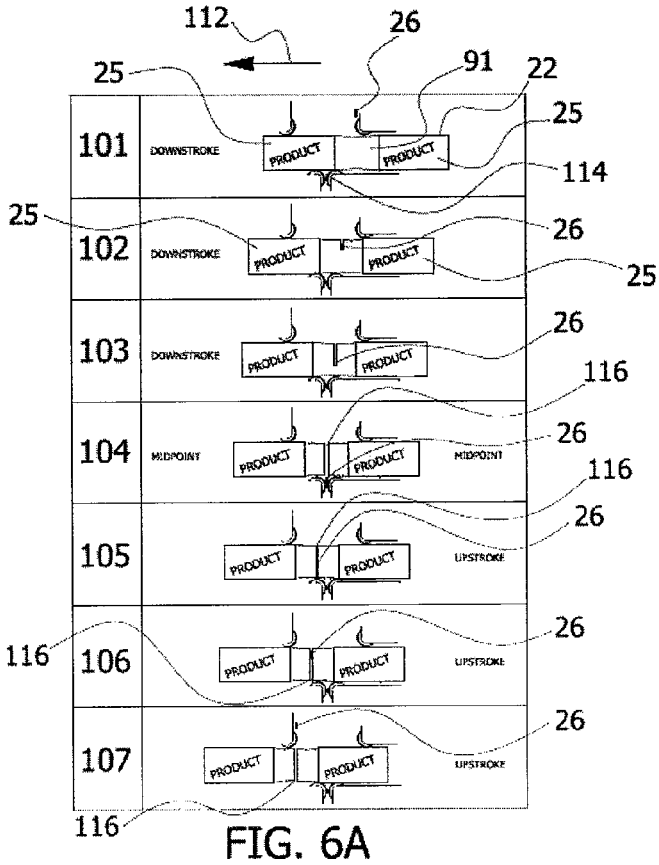
FIGS. 6A and 6B are schematics of a first cutting path of the cutting assembly of the system of FIG. 1.
Figure 6B:
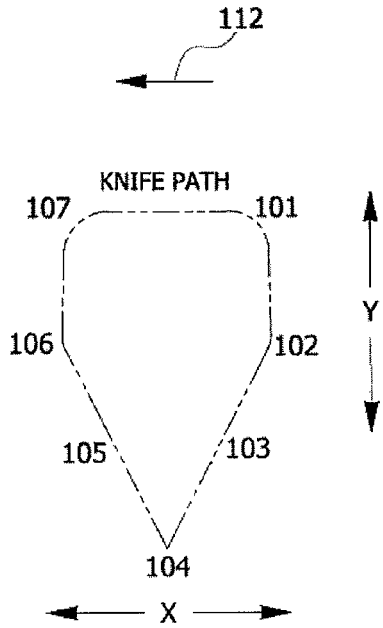

FIGS. 6A-7B are schematic illustrations of preferred cutting cycles for the heated cutting element 26 including motion in two coordinates, namely the horizontal and transverse or vertical direction. FIG. 6A and 6B illustrates a first cutting cycle wherein a single cut is made during a complete cycle. The illustrations in 6A illustrate the position of the heated cutting element 26 in relation to the tube 91 wrapped around a unit 25 of product 22. The schematic illustrated in 6B, shows the path of the heated cutting element 26, generally corresponding to the positions illustrated in FIG. 6A. The direction of travel of the units 25 and tube 91 is illustrated by the arrow 112. As illustrated in FIG. 6A the heated cutting element 26, begins its motion cycle at a position generally forward (in a direction opposite the motion of travel of the product 22 and tube 91) of the gap 114 between the forming shoulder product pull belts 58*a*, 58*b* and the knife exit belts 84*a*, 84*b*. The heated cutting element 26 begins its cutting motion with an initial downward transverse movement illustrated between positions 101 and 102. As the heated cutting element 26 engages the tube 91 in between sequential units 25, it continues its downward transverse movement, however, it moves horizontally as well as transversely. This two coordinate movement is illustrated in FIG. 6B between positions 102 and 103. The horizontal component of the motion is in the direction of the path of travel of the units 25 and tube 91 illustrated by arrow 112 and is preferably at a velocity equal to that motion. The transverse motion preferably occurs at a velocity greater than the horizontal motion. The two dimensional motion of the heated cutting element 26 continues between positions 103 and 104 as the heated cutting element 26 continues to move transversely and horizontally at a velocity equal to the velocity of the horizontal motion of the units 25 and tube 91. At position 104 the heated cutting element 26 has made a single cut 116 thereby separating two adjacent units 25 wrapped in the tube. The heated cutting element 26 pauses briefly at position 104 (near the gap 114 between the forming shoulder product pull belts 58*a*, 58*b* and the knife exit belts 84*a*, 84*b*).

Following the brief pause, the heated cutting element 26 continues its cutting cycle with upward transverse and horizontal motion asymmetrical to that occurring between positions 101 through 104. The movement of the heated cutting element 26 from positions 104 to 106 includes an upward or transverse component as well as a horizontal component. The horizontal component is in the same direction and at a velocity equal to the velocity of the horizontal motion of the product 22 and tube 91. As the heated cutting element 26 moves between positions 105 and 106 it is following the path of the previously formed cut 112. Between position 106 and 107, the heated cutting element 26 is no longer in the continuously moving tubular plastic 91 and it proceeds in solely transverse motion upward. Once the heated cutting element 26 completes its upward motion at position 107 it proceeds horizontally in a direction opposite the motion of travel of the product 22 and tube 91 back to position 101. The cycle is then repeated to form additional cuts.

Figure 7A:
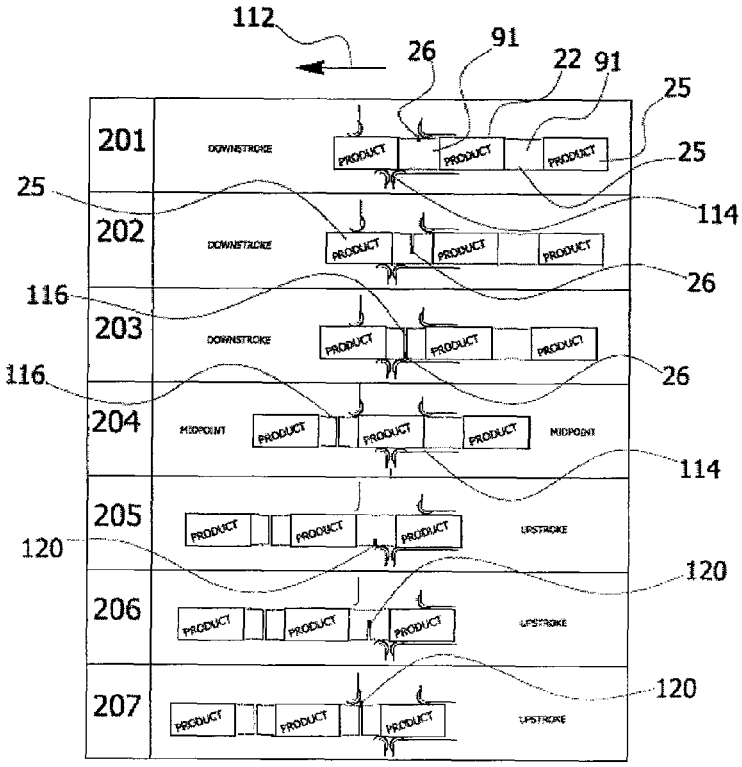
FIGS. 7A and 7B are schematics of an alternative cutting path of the cutting assembly of the system of FIG. 1.
Figure 7B:
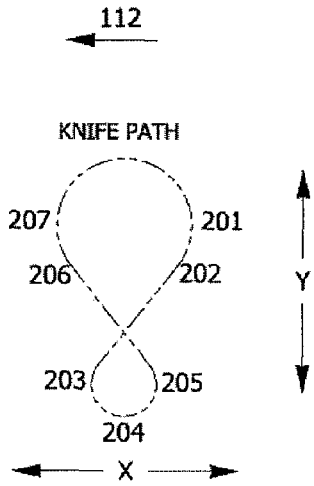

FIGS. 7A and 7B illustrate an alternative heated cutting element 26 cycle wherein two cuts are made during a complete cutting cycle. The illustrations on the left show the position of the heated cutting element 26 in relation to the units 25 wrapped in the continuously moving tube 91. The schematic illustrated in 7B, shows the path of the heated cutting element 26, generally corresponding to the positions illustrated in FIG. 7A. The direction of travel of the units 25 and tube 91 is illustrated by the arrow 112. As illustrated in FIG. 7A, the heated cutting element 26, begins its motion cycle at a position generally forward (in a direction opposite the motion of travel of the product 22 and tube 91) of the gap 114 between the forming shoulder product pull belts 58*a*, 58*b* and the knife exit belts 84*a*, 84*b*. The heated cutting element 26 begins its cutting cycle with an initial downward movement illustrated near position 201. As the heated cutting element 26 engages the tube 91 in between sequential units 25, it continues its downward vertical motion and moves horizontally as well. This is illustrated in the movement between positions 201 and 202 in FIG. 7B. The additional horizontal motion is in the direction of the path of travel of the units 25 and tube 91 and is preferably at a velocity equal to that motion. The two dimensional motion of the heated cutting element 26 continues between positions 202 and 203 as the heated element continues to move transversely and horizontally at a velocity equal to the velocity of the horizontal motion of the units 25 and tube 91. As the heated cutting element 26 moves beyond position 203 the heated cutting element 26 has made a single cut 116 separating two adjacent products. The heated cutting element 26 then moves in a direction opposite the movement of the horizontal motion of the units 25 and tube 91 between positions 204 and 205.

At position 205, the heated cutting element 26 continues its cycle with an upward transverse motion. As illustrated, between positions 205 and 206, the motion of the heated cutting element 26 includes a vertical or transverse component as well as a horizontal component. The horizontal component is again at a velocity equal to the velocity of the horizontal motion of the units 25 and tube 91 and in the same direction. As the heated cutting element 26 moves between positions 205 and 206 a new second cut 120 is formed. At position 207 the heated cutting element 26 has completed the second cut 120 and is no longer in the continuously moving tubular plastic 91. The heated cutting element 26 then proceeds vertically and horizontally in a direction opposite the motion of travel of the product 22 and tube 91 back to position 201.

In operation, the web 50 is continuously drawn from the supply roll 24 and fed forward at the requisite speed. As it travels forward, the web travels around rolls, up to the forming shoulder 60 of the tube wrapper forming section 40, around the shoulder 60 and into and through a guide of the former. One or multiple spaced products 22 are continuously fed forward in units 25, one after another, by the infeed assembly 40 coming into position on the web 50 as it travels forward. The web is formed into the tube 91 around the units 25 of product, the tube with the units 25 therein being drawn forward at a predetermined tube feed speed by the forming shoulder product pull belts 58*a*, 58*b*. As the leading (downstream) end of the tube 91 enters the cutting assembly 70, the moveable heated cutting element 26 engages the tube to sever it between a leading edge and the remainder of the tube as the knife exit belts 84*a*, 84*b* pull the leading cut tube 91 with the units 25 therein forward. The heated cutting element 26 either returns along the cut line 116 or forms a second cut 120 in the tube 91 to sever the tube with the unit 25 therein away from the tube. If the second cut 120 is not formed in the single cycle illustrated in FIGS. 7A and 7B the second cut 120 is formed and the product separated by a repeat of the first cycle. Using either cycle, the unit 25 is separated from the tube, each comprising a wrapper with a single product or multiple products therein with the ends of the wrapper extending beyond the ends of the unit 25. As is known in the art, these projecting wrapper ends are subsequently folded in on the ends of the unit 25 and sealed to complete the package as is known in the art. This occurs on the assembly 20 downstream of the knife exit belts 84*a*, 84*b* at by way of, e.g., a left rear tucker assembly, a right rear tucker assembly, a flight table and sealer discharge belts. These downstream components are well known in the art and need not be disclosed in detail.

It will be observed that the wrappers surrounding the products are, in effect, measured as a result of the timed relation between the speed of feed of the web 50, the speed of the single registration belts 32 and the twin pack registration belts 33 and the speed of the heated cutting element 26 moving through the tube. It should also be understood that the in feed compression belts 30, the single registration belts 32 and the twin pack registration belts 33, the forming shoulder infeed belts 44*a*, 44*b*, the forming shoulder product pull belts 58*a*, 58*b*, the knife exit belts 84*a*, 84*b* and the movement of the heated cutting element 26 are all servomotor driven. Each servomotor can be readily adjusted to allow for alternative spacing of the units 25 within the tube 91.

Although the best mode contemplated by the inventor of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, as noted throughout the application the individual components need not be formed in the disclosed shapes, or assembled in the disclosed configuration, but could be provided in virtually any shape, and assembled in virtually any configuration, so as to provide for a wrapping system that includes a programmable infeed system and a cutting system that uses a moveable cutting element.

Furthermore, all the disclosed features of each disclosed embodiment can be combined with, or substituted for, the disclosed features of every other disclosed embodiment except where such features are mutually exclusive. For example, although a preferred infeed system 28 is disclosed, it is recognized that other infeed systems including prior art infeed systems could be used with the inventive cutting assembly 70.

It is intended that the appended claims cover all such additions, modifications and rearrangements. Expedient embodiments of the present invention are differentiated by the appended claims.

The invention claimed is:

1. A method of packaging products in a tubular thermoplastic material comprising:

forming a moving tube of thermoplastic material from a web of said material;

delivering spaced product units to be wrapped into the tube; and separating the spaced product units in the tube from one another with a heated cutting element that travels along a cutting path defining a horizontal velocity component of at least about 80 feet per minute the cutting path defining a first cutting segment and a second cutting segment that cross each other at a crossing point, wherein while traveling through a single cycle of the cutting path, the heated cutting element passes through the crossing point (i) once in a downward direction and (ii) once in an upward direction.

2. The method of claim 1, wherein the heated cutting element is moveable in two mutually orthogonal directions.

3. The method of claim 2, wherein the step of separating the spaced product units from one another comprises moving the heated cutting element transversely through the tube and in the same direction of movement as the tube of thermoplastic material.

4. The method of claim 3, wherein at least a portion of the movement of the heated cutting element in the same direction of movement of the tube is at a velocity that matches the velocity of the movement of the tube.

5. The method of claim 3, wherein the step of separating the spaced product units from the tube comprises making a first cut in the tube in a downward transverse motion and making a second cut in the tube in an upward transverse motion.

6. The method of claim 1, wherein the heated cutting element is mounted on at least one moveable carriage moveable in a first direction and said moveable carriage is mounted on at least one carriage arm moveable in a second direction that is perpendicular to the first direction.

7. The method of claim 6, wherein a forming shoulder pull belt is provided for feeding the spaced product units within the tube, toward the cutting element, and the carriage arm is mounted on a support located adjacent the forming shoulder pull belt.

8. The method of claim 1, wherein the spaced product units are at least one stack of napkins.

9. The method of claim 1, wherein the spaced product units are at least one roll of paper product.

10. A method of packaging products in a tubular thermoplastic material comprising:

forming a moving tube of thermoplastic material from a web of said material;

delivering spaced product units to be wrapped into the tube; and separating the spaced product units in the tube from one another with a heated cutting element; and moving the heated cutting element through a cutting path that defines, (i) a first cutting segment through which the heated cutting element moves downwardly through the tube;

(ii) a second cutting segment that intersects and crosses through the first cutting segment, the heated cutting element moving upwardly through the tube while moving through the second cutting segment;

(iii) a lower direction change segment connecting lower portions of the first and second cutting segments; and (iv) an upper direction change segment connecting upper portions of the first and second cutting segments.

11. The method of claim 10, wherein the cutting path defines an upright figure-eight shape in which the lower and upper direction change segments extend arcuately between the first and second cutting segments.

12. The method of claim 11, wherein the heated cutting element travels a greater horizontal distance while moving through the upper direction change segment than it does while moving through the lower direction change segment.

* * * * *